US010005637B1

(12) United States Patent
Wilsher et al.

(10) Patent No.: US 10,005,637 B1
(45) Date of Patent: Jun. 26, 2018

(54) SLIDING CENTER TRAY PAPER REMOVAL

(71) Applicant: Xerox Corporation, Norwalk, CT (US)

(72) Inventors: Michael John Wilsher, Herts (GB); Sebastián Rodrigo de Echaniz, Milton Keynes (GB); Benjamin Thomas Thurnell, Hertfordshire (GB); Paul Simon Golding, Hertford (GB)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/586,788

(22) Filed: May 4, 2017

(51) Int. Cl.

| | |
|---|---|
| ***B65H 31/04*** | (2006.01) |
| ***B65H 31/22*** | (2006.01) |
| ***B65H 31/00*** | (2006.01) |
| ***B65H 7/20*** | (2006.01) |
| ***B65H 7/02*** | (2006.01) |
| ***B65H 31/30*** | (2006.01) |

(52) U.S. Cl.
CPC ..... *B65H 31/22* (2013.01); *B65H 7/02* (2013.01); *B65H 7/20* (2013.01); *B65H 31/00* (2013.01); *B65H 31/3054* (2013.01); *B65H 31/3063* (2013.01); *B65H 2405/324* (2013.01)

(58) Field of Classification Search
CPC ... B65H 7/00; B65H 7/02; B65H 7/14; B65H 31/00; B65H 31/22; B65H 31/30; B65H 31/3054; B65H 31/3063; B65H 2402/30; B65H 2402/32; B65H 2405/10; B65H 2405/11; B65H 2405/32; B65H 2405/324; B65H 2405/354
See application file for complete search history.

(56) References Cited

U.S. PATENT DOCUMENTS

| | | | | |
|---|---|---|---|---|
| 5,860,647 | A * | 1/1999 | Ikesue | B65H 29/14 271/207 |
| 8,376,361 | B2 * | 2/2013 | Brewer, III | B65H 29/60 271/176 |
| 8,794,616 | B2 * | 8/2014 | Matsuki | G03G 15/6544 270/58.07 |
| 2001/0009625 | A1 * | 7/2001 | Tamehira | B41J 13/106 399/406 |
| 2007/0085257 | A1 * | 4/2007 | Kang | B65H 31/22 270/58.07 |
| 2010/0019446 | A1 * | 1/2010 | Matsumoto | B65H 31/10 271/302 |
| 2015/0175376 | A1 * | 6/2015 | Nakano | B65H 31/02 271/214 |
| 2016/0282803 | A1 * | 9/2016 | Osaki | G03G 21/1647 |
| 2017/0015516 | A1 * | 1/2017 | Miyazaki | B65H 5/068 |

* cited by examiner

*Primary Examiner* — Prasad V Gokhale
(74) *Attorney, Agent, or Firm* — Fay Sharpe LLP

(57) ABSTRACT

An image rendering apparatus and method of operating a center tray of an image rendering apparatus. The image rendering apparatus includes a cavity, and a center tray having a home position located within the cavity and a retrieval position located outside the cavity. The image rendering apparatus further includes a retraction mechanism that is attached to the center tray and an interior wall of the cavity. The retraction mechanism is configured to allow for the extension of the center tray from the home position to the retrieval position, and from the retrieval position to the home position.

26 Claims, 8 Drawing Sheets

SLIDING CENTER TRAY PAPER REMOVAL

BACKGROUND

The presently disclosed embodiments are directed toward methods and systems for printing, reproducing documents, or reproducing images. More particularly, the teachings disclosed herein are applicable to methods, systems, and an apparatus wherein retrieval of output documents in restricted spaces is rendered more accessible.

An image rendering apparatus, such as a multifunction device, is generally capable of performing a variety of services, including one or more of printing, scanning, copying, facsimile, storage, electronic mailing, and the like. Image rendering devices are available in a plurality of deferent sizes, dictated, in part, by the environment in which they will be placed. For example, larger or faster devices will be placed in those environments having a large number of users or outputting a large number of print jobs. To facilitate these types of environments, image rendering apparatus manufacturers have increased the available medium storage capacity, i.e. input paper trays, to allow the devices to output printed materials without requiring constant replenishment by users.

This trend in current machines to have increased paper capacity forces the print engine of the machine to sit higher. As a result of this placement, the available space for the center tray is severely restricted. Accordingly, a smaller center tray is utilized relative to past devices, making retrieval of paper from the center tray more restrictive.

There remains a need for a system and method for assisting a user in retrieving output paper from the center tray of an image rendering apparatus.

BRIEF DESCRIPTION

In one embodiment of this disclosure, described is an image rendering apparatus that includes a cavity, and a center tray having a home position located within said cavity and a retrieval position located outside said cavity. The image rendering apparatus further includes a retraction mechanism mechanically coupled to the center tray and at least one interior wall of said cavity, wherein the retraction mechanism is configured to allow for extension of the center tray from the home position to the retrieval position, and from the retrieval position to the home position.

In another embodiment of this disclosure, described is a method for center tray retrieval of on an image rendering apparatus. The method includes the steps of receiving a document processing request representative of an operation of the image rendering apparatus, and receiving sensor output from a sensor located within a cavity of the image rendering apparatus, the sensor output corresponding to a position of the center tray located therein. The method further comprises the steps of responsive to the center tray in a home position, performing the received document processing request, and actuating a retraction mechanism operatively coupled to the center tray to extend the center tray from a home position in the cavity to a retrieval position outside the cavity.

In still another embodiment of this disclosure, described is an image rendering apparatus that includes a cavity, a center tray having a home position located within the cavity and a retrieval position located outside the cavity, a retraction mechanism mechanically coupled to the center tray and at least one interior wall of the cavity, wherein the retraction mechanism is configured to allow for extension of the center tray from the home position to the retrieval position, and from the retrieval position to the home position. The image rendering apparatus also includes a processor and memory in communication with the processor. The memory stores instructions which are executed by the processor and cause the processor to determine a position of the center tray in the cavity, and enable operations of the image rendering apparatus in response to a determination that the center tray is in the home position.

DETAILED DESCRIPTION

Figure 1:
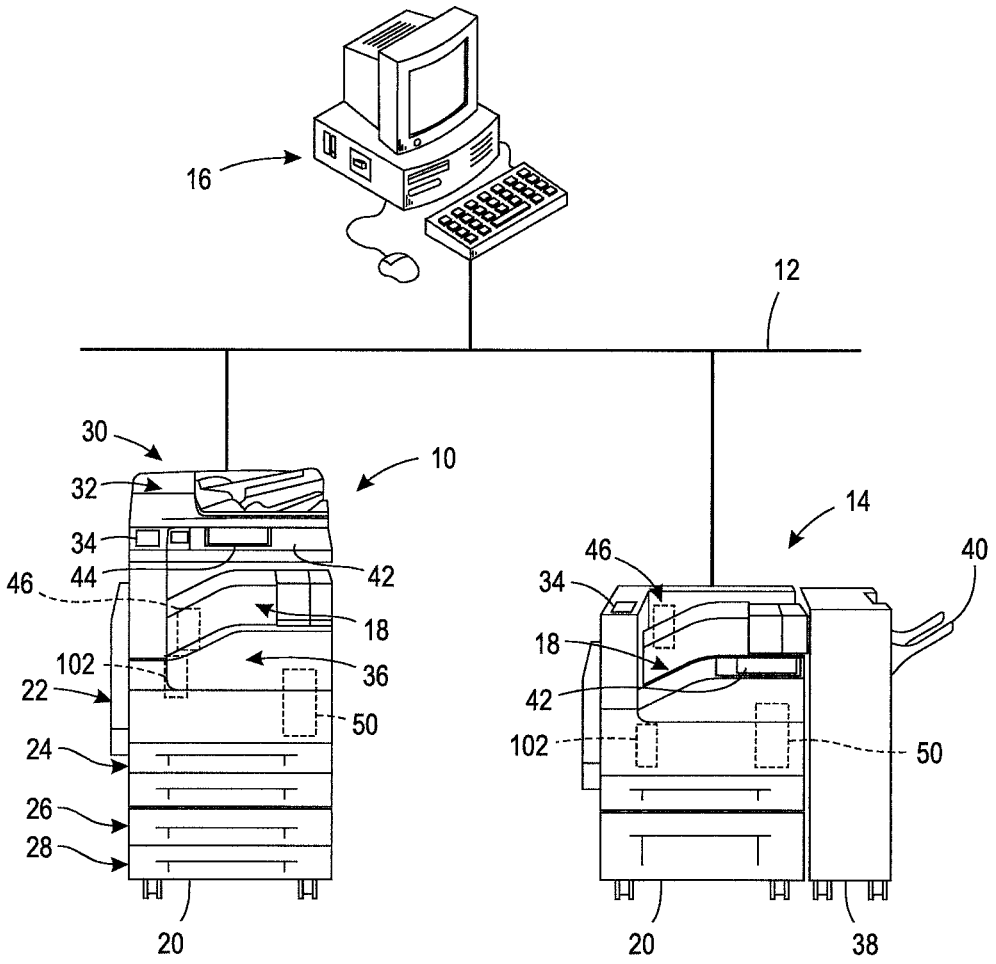
FIG. 1 is a schematic view of a network printing system in accordance with one embodiment of the subject application.

One or more implementations of the subject application will now be described with reference to the attached drawings, wherein like reference numerals are used to refer to like elements throughout.

The subject application presents methods, systems, and devices for providing an ability to allow the center tray of an image rendering apparatus to extend outward from the device for retrieval, extend laterally from the device for retrieval, swing around a pivot to allow retrieval of paper, utilize an automatic extension and/or retraction mechanism to open and/or close the center tray, thereby ensuring that the center tray is always in the correct position when the device runs. Embodiments disclosed herein include manual opening and closing the center tray, manual opening and mechanical closing of the center tray, manual opening and electrical closing of the center tray, as well as electric opening and closing of the center tray. In some embodiments, a sensor is equipped that detects when the center tray is in the open position, wherein the controller or other suitable component prevents the device from running and outputting paper until the center tray is returned to the home position. Similar embodiments utilize the aforementioned sensor to automatically retract the center tray.

Turning now to FIG. 1, there is shown an exemplary printing system that includes an image rendering apparatus 10, such as a printer, scanner, fax machine, or multifunction device having two or more of these functionalities. The image rendering apparatus 10 may be connected by a network 12 to other devices 14, 16, such as one or more other image rendering apparatuses 14 and one or more computing devices 16. Each image rendering apparatus 10, 14 may be similarly configured, except as noted.

The image rendering apparatus 10 includes a media supply unit 20, which includes a set of one, two, or more print media sources, such as paper trays 22, 24, 26, 28, which may vary in configuration for accepting different types/sizes of print media, such as paper sheets. An image input unit 30 includes a scanner 32 and/or digital input 34, such as a USB port, for receiving/generating an image of a document to be rendered. A rendering unit 36, such as one or more marking engines, renders the image on print media supplied by the media supply unit 20 using marking media, such as inks or toners. The image rendering apparatus 10, 14 may include, as shown in FIG. 1, a finishing unit 38 receives the printed media from the rendering unit and optionally provides one or more finishing operations, such as collating, stapling, binding, stacking, or the like. An output unit 40, such as an output tray or trays, outputs the finished, printed media. Units 20, 36, 38, 40 are connected by a paper path (not shown) comprising belts, rollers, and the like, which transport the print media from the media supply unit 20 to the output unit 40, via the rendering unit 36 and (optional) finishing unit 38.

A user interface device 42 is fixedly or removably mounted to an exterior of the image rendering apparatus 10 and includes a display device 44, such as an LCD screen, as will be appreciated by those skilled in the art. A graphical user interface (GUI) may be displayed on the display device 44. The GUI provides a preview of how the scanned or otherwise input image will appear when rendered on different print media. The GUI is generated by a control unit 50, as will be appreciated by those skilled in the art.

Figure 2:
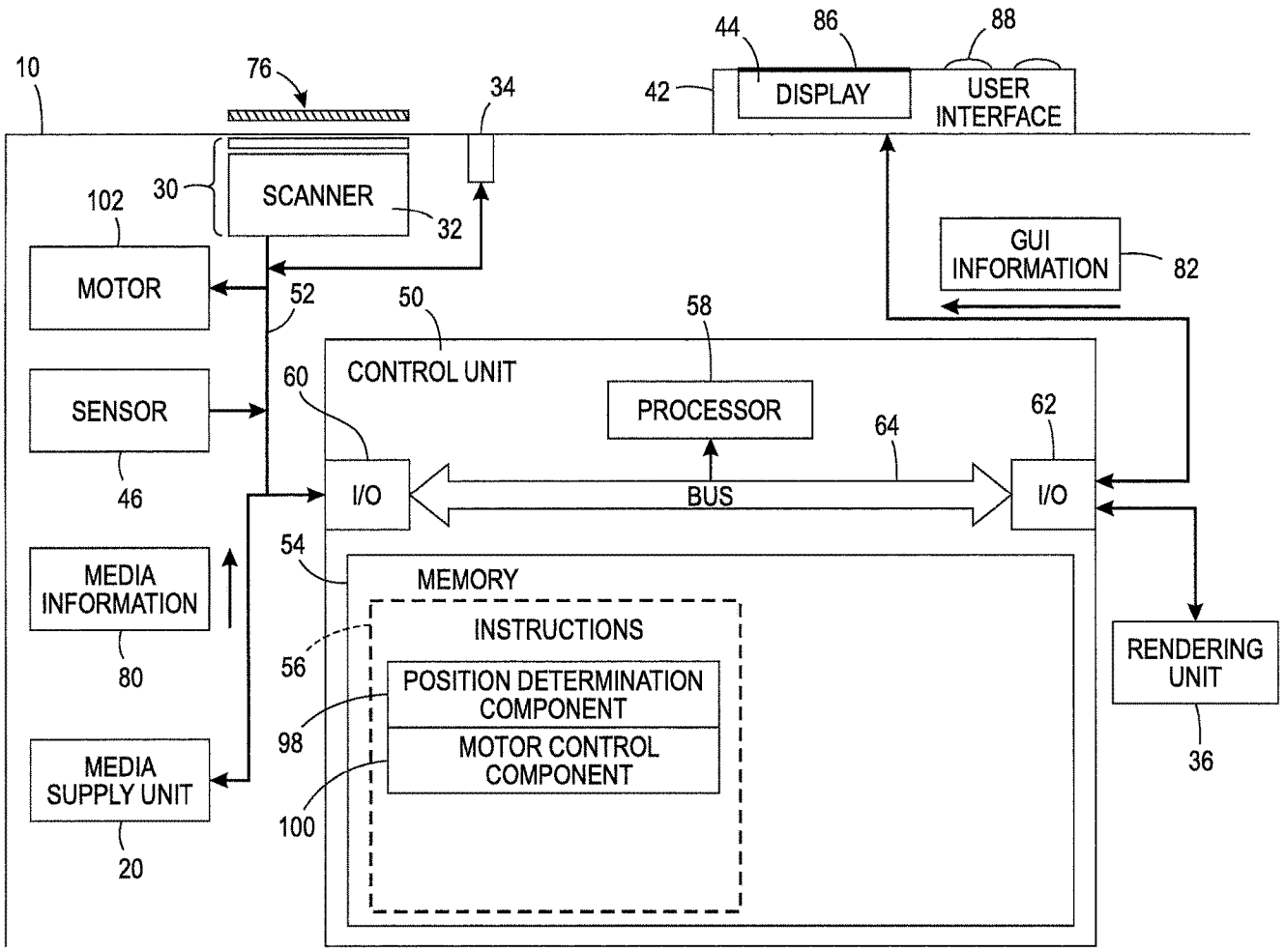
FIG. 2 is a functional block diagram of the image rendering apparatus of FIG. 1.

The control unit 50 is communicatively connected with the media supply unit 20, image input unit 30, user interface 42, rendering unit 36 and optional finishing unit 38 by wired or wireless connections 52 shown in FIG. 2. It will be appreciated that the control unit 50 may be located in the image rendering apparatus 10, 14, or may be wholly or partially located elsewhere in the printing system illustrated in FIG. 1, as on a network print server (not shown), or the like. The illustrated control unit 50 includes memory 54 which stores software instructions 56 for controlling operations of the image rendering apparatus 10, 14, and a processor 58 in communication with the memory for executing the instructions. The control unit 50 also includes one or more input/output (I/O) devices 60, 62, for communicating with other components of the image rendering apparatus 10, such as the image input unit 30 and user interface device 42. Hardware components 54, 58, 60, 62 of the control unit 50 may communicate via a data/control bus 64, as illustrated in FIG. 2.

The control unit 50 receives image information from the image input unit 30, generated by scanning a physical document 76. The control unit 50 receives media information 80 from the media supply unit 20, such as the currently-available types and sizes of print media for output by the image rendering apparatus 10, 14. It will appreciated that the image information 70 may originate, for example and without limitation, from an email message, from a facsimile transmission, via the network 12, or the like.

The control unit 50 outputs GUI information 82 to the user interface device 42 for generating the GUI and receives user input information from the user interface 42 corresponding to user inputs to the user interface. The user may interact with the user interface via a user input device, such as a touch screen 86, buttons 88, combination thereof, or the like.

The control unit 50 may also control various processing and operating functions of the image rendering apparatus 10, 14, such as copying, printing, paper feeding, finishing, and the like.

According to one embodiment, the control unit 50 may be in communication with the sensor 46 to determine, in accordance with a position determination component 98, the position of the center tray 18. That is, the control unit 50 determines whether the center tray 18 is in the home position or the extended, image/document retrieval position. In accordance with one embodiment, when the position determination component 98 determines the center tray 18 to be in the extended position, the control unit 50 may prohibit document processing operations of the image rendering apparatus 10, 14 until the center tray 18 is retracted, i.e. returns to the home position. Furthermore, depending upon the configuration of the image rendering apparatus 10, 14, the control unit 50 may activate or otherwise direct a motor control component 100 to retract the center tray 18, as discussed in greater detail below.

As shown in FIG. 2, the motor control component 100 is in communication with the processor 58 of the control unit 50 and the motor 102. As previously discussed, the inclusion of the motor control component 100 is representative of one exemplary embodiment reflecting the automatic extension and/or retraction of the center tray 18 during operations of the image rendering apparatus 10, 14. It will be understood that the motor 102 is representative of any suitable retraction drive mechanism capable of extending and or retracting the center tray 18. Suitable examples include, without limitation, hydraulic actuators, tension spring-driven mechanisms, spring-driven mechanisms, electric motors, gear drives, manual activation, and the like. Actuation of the motor 102 via the motor control component 100 may be accomplished upon determination as to the position of the center tray 18, e.g. detection that the tray 18 is extended, upon completion of a document processing operation, e.g. the tray 18 is to be extended for retrieval of the print document, and the like.

The control unit 50 may include one or more computing devices, such as a central processing unit, microprocessor, or other computing device capable of executing instructions for performing the exemplary method set forth in FIG. 8, discussed below. The memory 54 may represent any type of non-transitory computer readable medium such as random access memory (RAM), read only memory (ROM), magnetic disk or tape, optical disk, flash memory, or holographic memory. In one embodiment, the memory 54 comprises a combination of random access memory and read only memory. In some embodiments, the processor 58 and memory 54 may be combined in a single chip. Memory 54 stores instructions for performing the exemplary method illustrated in FIG. 8 as well as the processed data. The digital processor device 58 can be variously embodied, such as by a single-core processor, a dual-core processor (or more generally by a multiple-core processor), a digital processor and cooperating math coprocessor, a digital controller, or the like. The I/O interfaces 60, 62 may comprise a modulator/demodulator (MODEM) a router, a cable, and/or Ethernet port.

The term "software," as used herein, is intended to encompass any collection or set of instructions executable by a computer or other digital system so as to configure the computer or other digital system to perform the task that is the intent of the software. The term "software" as used herein is intended to encompass such instructions stored in storage medium such as RAM, a hard disk, optical disk, or the like, and is also intended to encompass so-called "firmware" that is software stored on a ROM or the like. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on a server or other location to perform certain functions.

Referring now to FIGS. 3A-7, there are shown varying embodiments, but not limited to the image rendering apparatus 10, 14 with accessible center tray 18 implementing aspects of the subject application. As illustrated in FIGS. 3A-3B, 4A-4B, an exemplary image rendering apparatus 10 includes the media supply unit 20 with corresponding paper trays 22, 24, 26, 28 as previously addressed in FIG. 1. The image rendering apparatus 10 of FIGS. 3A, 3B, 4A, and 4B depicts a first embodiment of the sliding center tray 18 implemented in accordance with the subject application. It will be appreciated that the center tray 18 is located in a cavity 302 above the printer engine (not shown), and relatively inaccessible to the associated user due to the presence of a substantial media supply 20. The skilled artisan will understand that the output to the center tray 18 is typical in single document reproduction or facsimile output, however other operations of the image rendering apparatus 10, 14 may utilize the center tray 18 depending, for example, on the type of operation, the output media, e.g. paper size, paper tray 24, 26, 28 selection, or the like.

Figure 3A:
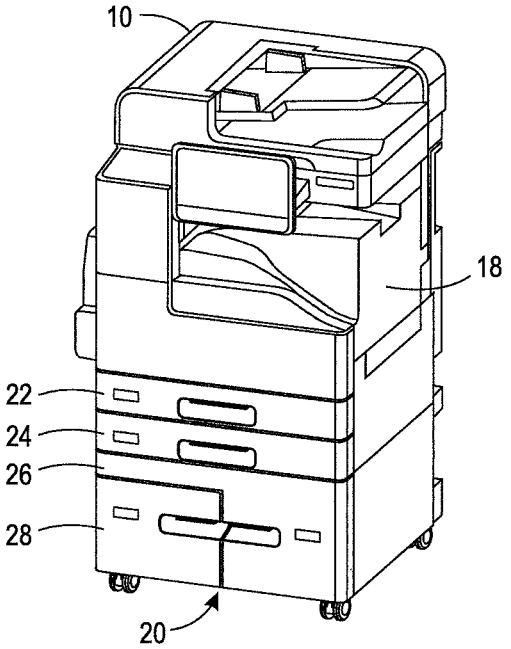
FIG. 3A is a three-dimensional view of an image rendering apparatus including a lateral sliding center tray in the home position in accordance with one embodiment of the subject application.
Figure 3B:
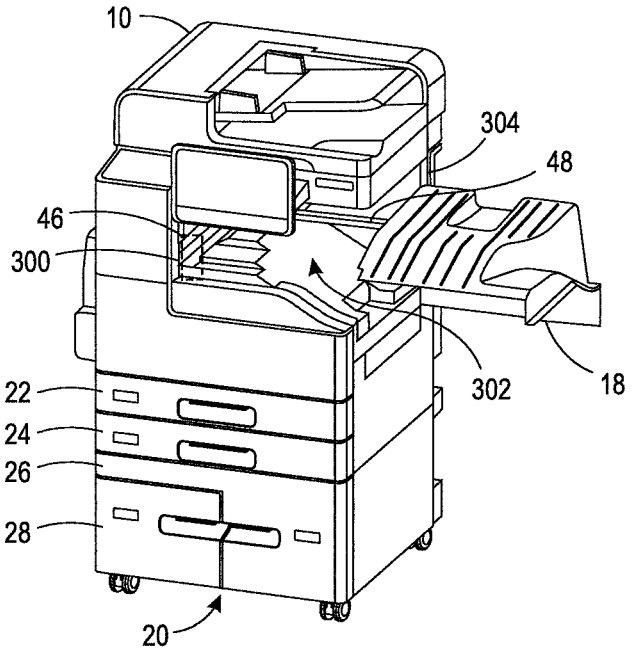
FIG. 3B is a three-dimensional view of the image rendering apparatus of FIG. 3A including the lateral sliding center tray in the retrieval position in accordance with one embodiment of the subject application.
Figure 4A:
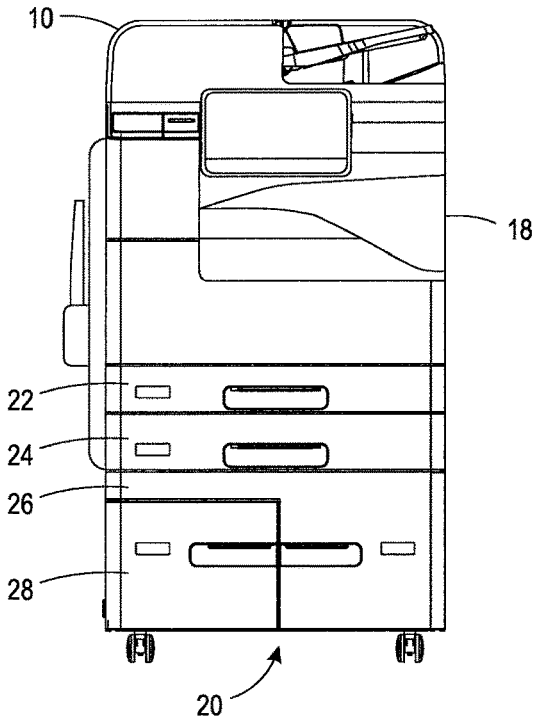
FIG. 4A is a front view of the image rendering apparatus of FIG. 3A including the lateral sliding center tray in the home position in accordance with one embodiment of the subject application.
Figure 4B:
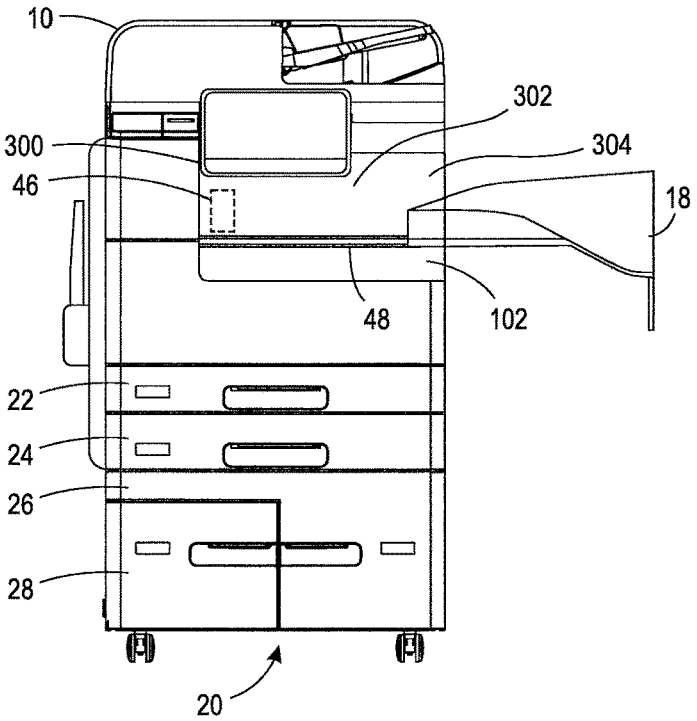
FIG. 4B is a front view of the image rendering apparatus of FIG. 3A including the lateral sliding center tray in the retrieval position in accordance with one embodiment of the subject application.

In FIGS. 3A-4B, the image rendering apparatus 10 is not equipped with the optional finishing unit 38, allowing for the center tray 18 to extend parallel to the back of the device 10. Accordingly, FIGS. 3A and 4A depict the image rendering apparatus 10 having the center tray 18 in the home position, wherein the image rendering apparatus 10 is capable of performing document processing operations as normal. FIGS. 3B and 4B, however, depict the image rendering apparatus 10 with the center tray 18 in the extended position, wherein operations of the image rendering apparatus 10 may be prohibited via the control unit 50 as referenced above.

A retraction mechanism 48 is also depicted in FIGS. 3B and 4B, the retraction mechanism 48 is intended to illustrate one possible mechanism to allow the center tray 18 to slide/extend out for document retrieval and return/retract to the home position for further operations. The retraction mechanism 48 may be implemented as a telescoping rail, ball bearing track, geared track, rack, etc., and may be manually, electrically, or mechanically (automatically) activated. According to one embodiment, when the center tray 18 is manually extended to retrieve output copies, the retraction mechanism 48 may automatically activate to return the center tray 18 to the home position after a predetermined amount of time, or actuation via the control unit 50. In another embodiment, a motor 102 is positioned within the image rendering apparatus 10, 14 having affixed thereto a suitable sprocket to drive the center tray 18 outward along the retraction mechanism 48 enabling retrieval of documents output thereon, as well as to return the center tray 18 to the home, i.e. operating, position.

It will be appreciated that the center tray 18 need not extend fully as illustrated in FIGS. 3B and 4B and that such illustration is merely intended as an example demonstrating the direction of travel of the center tray 18. That is, the skilled artisan will appreciate that while illustrated as fully extending outward, the center tray 18 may only need extend a portion, e.g. enough to allow retrieval of the output by a user, i.e., greater than 0%, but less than 100%. For example, the center tray 18 may extend 20% to 90% outward, and more preferably between 25% and 50%, so as to allow for ease of access to the output, while ensuring quick retraction to the home position for additional operations by the image rendering apparatus 10.

Accordingly, the distance of the extension of the center tray 18 may be limited based upon weight of the center tray 18, size/strength of retraction mechanism (if so equipped), location of the image rendering apparatus 10 relative to walls, etc., and the like. In the embodiment depicted in FIGS. 3A-4B, the image rendering apparatus 10 further includes at least one optional position sensor 46, configured to detect the position of the center tray 18 during operations of the image rendering apparatus 10. For example, the sensor 46 may be for example, but not limited to a simple mechanical switch, magnetically activated reed switch or Hall Effect sensor, optical interrupt sensor, or other positional mechanism, as will be appreciated by those skilled in the art. The sensor 46 is shown as positioned adjacent an interior wall 300 of the cavity 302 in which the center tray 18 is located. However, the sensor 46, dependent upon the direction in which the center tray 18 extends/retracts, may be positioned at different locations within the cavity 302 of the image rendering apparatus 10, 14. Furthermore, it will be appreciated that the sensor 46 may be positioned on the center tray 18 itself, or affixed to the motor 102 (dependent upon the location of the motor 102). Alternative placement of the sensor 46 will be understood by those skilled in the art, such that the sensor 46 is suitably located to detect the position of the center tray 18.

Alternatively, in place of the sensor 46, the control unit 50 may determine the position of the center tray 18 via the position determination component 98 monitoring travel of the center tray 18 during operations of the image rendering apparatus 10. That is, the position determination component 98 utilizes the memory 54 to store information about whether a motor 102 has extended or retracted the center tray 18, as will be appreciated by those skilled in the art. In such an embodiment, the control unit 50 may be configured to actuate the motor 102 (or mechanical retraction means) to return the center tray 18 to the home position after a predetermined interval has expired. That is, after a predetermined amount of time has elapsed, the control unit 50 actuates the retraction mechanism 48 via motor 102 or other to return the center tray 18 to the home position to allow further operations of the image rendering apparatus 10, 14.

Figure 5A:
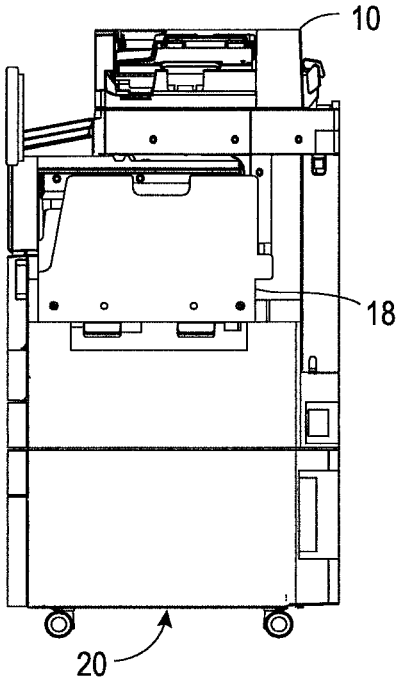
FIG. 5A is a side view of an image rendering apparatus including a perpendicularly sliding center tray in the home position in accordance with one embodiment of the subject application.
Figure 5B:
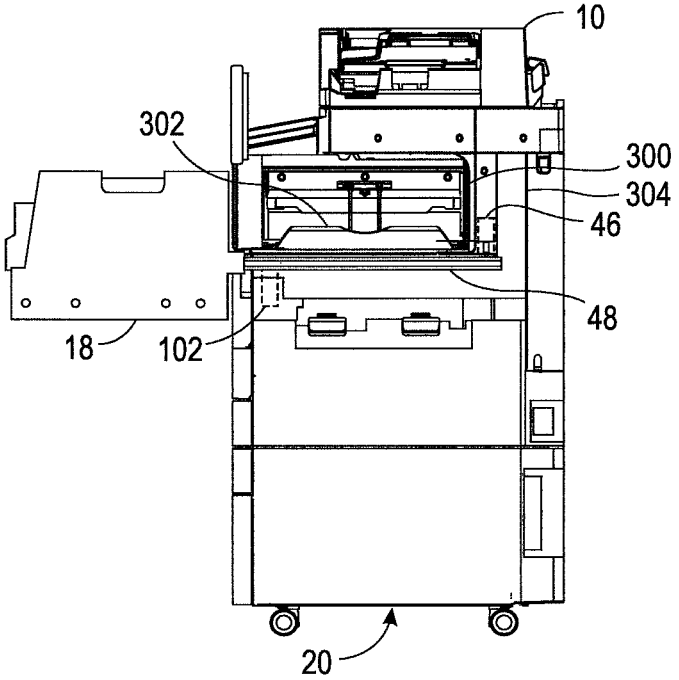
FIG. 5B is a side view of the image rendering apparatus of FIG. 5A including the perpendicularly sliding center tray in the extended/retrieval position in accordance with one embodiment of the subject application.

Turning now to FIGS. 5A and 5B, there is illustrated another embodiment of the image rendering apparatus 10 depicted in FIG. 1. In contrast to the depiction of FIGS. 3A-4B, the image rendering apparatus 10 of FIGS. 5A and 5B is configured to extend/retract the center tray 18 via the front of the image rendering apparatus 10. That is, as shown in FIGS. 5A-5B, the center tray 18 is configured to extend perpendicularly from the front of the image rendering apparatus 10.

As shown, FIG. 5A depicts the image rendering apparatus 10 having the center tray 18 in the home position, wherein the image rendering apparatus 10 is capable of performing document processing operations as normal. In contrast, FIG. 5B depicts the image rendering apparatus 10 with the center tray 18 in the extended position, wherein operations of the image rendering apparatus 10 may be prohibited via the control unit 50 as referenced above. The retraction mechanism 48 is also depicted in FIG. 5B. As discussed in detail above, the retraction mechanism 48 illustrates one possible mechanism to allow the center tray 18 to slide/extend out for document retrieval and return/retract to the home position for further operations. Furthermore, the retraction mechanism 48 may be implemented as a telescoping rail, ball bearing track, geared track, rack, etc., and may be manually, electrically or mechanically (automatically) activated. The retraction mechanism 48 is located along the wall 300 of the cavity 302, enabling the center tray 18 to extend perpendicularly outward from the image rendering apparatus 10, as shown in FIG. 5B.

Furthermore, as with the embodiment discussed above with respect to FIGS. 3B and 4B, the center tray 18 need not extend fully as illustrated in FIG. 5B and that such illustration is merely intended as an example demonstrating the direction of travel of the center tray 18. That is, the skilled artisan will appreciate that while illustrated as fully extending outward, the center tray 18 may only need extend a portion, e.g. enough to allow retrieval of the output by a user, i.e., greater than 0%, but less than 100%. For example, the center tray 18 may extend 20% to 90% outward, and more preferably between 25% and 50%, so as to allow for ease of access to the output, while ensuring quick retraction to the home position for additional operations by the image rendering apparatus 10.

Accordingly, the distance of the extension of the center tray 18 may be limited based upon weight of the center tray 18, size/strength of retraction mechanism (if so equipped), location of the image rendering apparatus 10 relative to walls, etc., and the like. In the embodiment illustrated in FIGS. 5A-5B, the at least one position sensor 46 is configured to detect the position of the center tray 18 during operations of the image rendering apparatus 10. Suitable examples of such a sensor 46 include, without limitation a simple mechanical switch, magnetically activated reed switch or Hall Effect sensor, optical interrupt sensor, or other positional mechanism, as will be appreciated by those skilled in the art. It will be appreciated that while shown in FIG. 5B as positioned adjacent the interior wall 300 of the cavity 302 in which the center tray 18 is located, the sensor 46 may also be positioned adjacent the back wall 304 of the cavity 302. Furthermore, the sensor 46, may be positioned at different locations within the cavity 302 of the image rendering apparatus 10, 14, or alternatively positioned on the center tray 18 itself, or affixed to the motor 102 (dependent upon the location of the motor 102). Alternative placement of the sensor 46 will be understood by those skilled in the art, such that the sensor 46 is suitably located to detect the position of the center tray 18.

It will be appreciated that while a sensor 46 is utilized in the illustration of FIG. 5B, the control unit 50 may determine the position of the center tray 18 via the position determination component 98 monitoring travel of the center tray 18 during operations of the image rendering apparatus 10. That is, the position determination component 98 utilizes the memory 54 to store information about whether a motor 102 has extended or retracted the center tray 18, as will be appreciated by those skilled in the art.

Figure 6A:
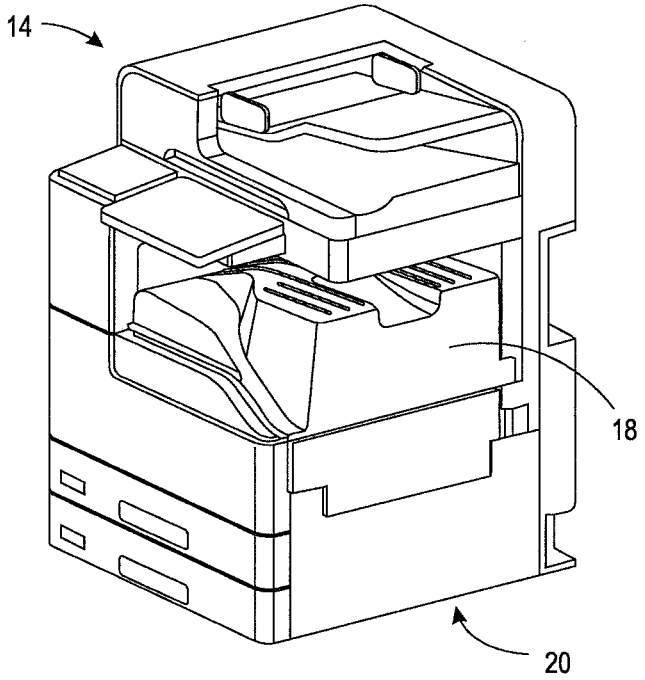
FIG. 6A is a three-dimensional view of an image rendering apparatus including a front sliding center tray in the home position in accordance with one embodiment of the subject application.
Figure 6B:
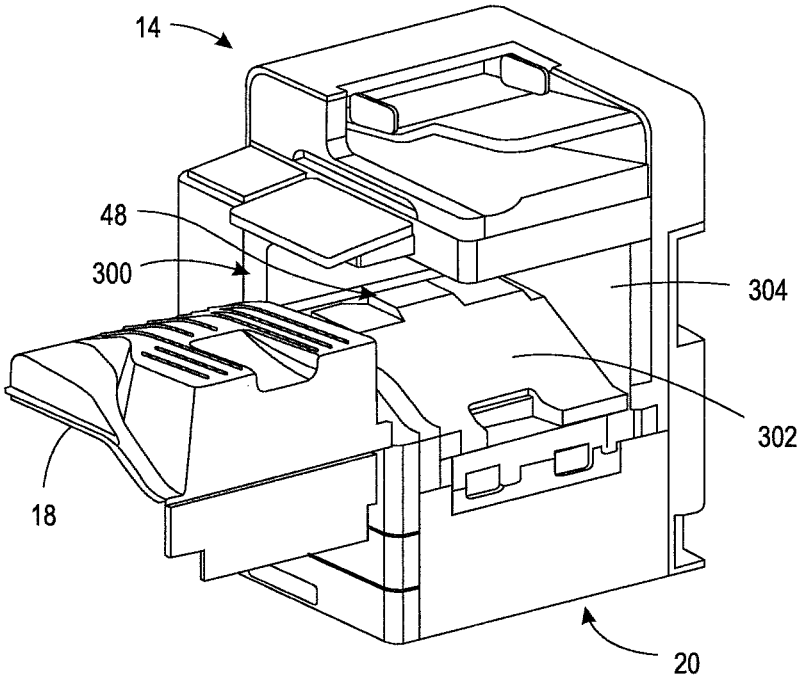
FIG. 6B is a three-dimensional view of the image rendering apparatus of FIG. 6A including the front sliding center tray in the retrieval position in accordance with one embodiment of the subject application.

Referring now to FIGS. 6A and 6B, there is illustrated an embodiment of the image rendering apparatus 14 depicted in FIG. 1. In contrast to the depiction of FIGS. 3A-5B, the image rendering apparatus 14 of FIGS. 6A and 6B is representative of a different implementation of an image rendering apparatus, having a smaller media supply unit 20 consisting of a reduced number of media supply trays. It will be appreciated that the embodiment illustrated in FIGS. 6A-6B may be utilized on a desk, table, or other piece of suitable furniture or support, in contrast to the image rendering apparatus 10 of FIGS. 3A-5B, which is illustrated for use as a standalone unit, i.e. self-supporting floor configuration. Further, the image rendering apparatus 14 is depicted in FIGS. 6A-6B without the optional finishing unit 38 illustrated in FIG. 1 for purposes of illustrating the internal functionality of the center tray 18. Thus, the skilled artisan will appreciate that the center tray 18 implementations illustrated in FIGS. 3A-5B and 7A-7B (discussed in greater detail below) are capable of implementation on both image rendering apparatus 10, 14 configurations.

As shown, FIG. 6A depicts the image rendering apparatus 14 having the center tray 18 in the home position, wherein the image rendering apparatus 14 is capable of performing document processing operations as normal. In contrast, FIG. 6B depicts the image rendering apparatus 14 with the center tray 18 in the extended position, wherein operations of the image rendering apparatus 14 may be prohibited via the control unit 50 as referenced above with respect to the image rendering apparatus 10. The example embodiment of FIGS. 6A-6B is configured to extend/retract the center tray 18 via the front of the image rendering apparatus 14. That is, as shown in FIGS. 6A-6B, the center tray 18 is configured to extend perpendicularly from the front of the image rendering apparatus 14.

The retraction mechanism 48 is also depicted in FIG. 6B, the retraction mechanism 48 is intended to illustrate one possible mechanism to allow the center tray 18 to slide/extend out for document retrieval and return/retract to the home position for further operations. As discussed above with respect to FIGS. 3A-4B, the retraction mechanism 48 may be implemented as a telescoping rail, ball bearing track, geared track, rack, etc., and may be manually, electrically or mechanically (automatically) activated. The retraction mechanism 48 is located along the wall 300 of the cavity 302, enabling the center tray 18 to extend perpendicularly outward from the image rendering apparatus 14, as shown in FIG. 6B.

Furthermore, as with the embodiment discussed above with respect to FIGS. 3B, 4B, and 5B, the center tray 18 need not extend fully as illustrated in FIG. 6B and that such illustration is merely intended as an example demonstrating the direction of travel of the center tray 18. That is, the skilled artisan will appreciate that while illustrated as fully extending outward, the center tray 18 may only need extend a portion, e.g. enough to allow retrieval of the output by a user, i.e., greater than 0%, but less than 100%. For example, the center tray 18 may extend 20% to 90% outward, and more preferably between 25% and 50%, so as to allow for ease of access to the output, while ensuring quick retraction to the home position for additional operations by the image rendering apparatus 14.

Accordingly, the distance of the extension of the center tray 18 may be limited based upon weight of the center tray 18, size/strength of retraction mechanism (if so equipped), location of the image rendering apparatus 14 relative to walls, etc., and the like. Although not illustrated in FIG. 6B, the image rendering apparatus 14 may include an optional sensor that is configured to detect the position of the center tray 18 during operations of the image rendering apparatus 14. Exemplary sensors 46 include, without limitation a simple mechanical switch, magnetically activated reed switch or Hall Effect sensor, optical interrupt sensor, or other positional mechanism, as will be appreciated by those skilled in the art. It will be appreciated that the optional sensor may be positioned adjacent the interior wall 300 of the cavity 302 in which the center tray 18 is located, positioned adjacent the back wall 304 of the cavity 302, may be positioned at different locations within the cavity 302 of the image rendering apparatus 14, or alternatively positioned on the center tray 18 itself, or affixed to the motor 102 (dependent upon the location of the motor 102).

As with the embodiments illustrated in FIGS. 3A-5B, the control unit 50 may determine the position of the center tray 18 via the position determination component 98 monitoring travel of the center tray 18 during operations of the image rendering apparatus 14 with or without the optional sensor. Accordingly, the position determination component 98 may utilize the memory 54 to store position information of the center tray 18 or motor (not shown) operation information to determine whether the center tray has been extended or retracted.

Figure 7:
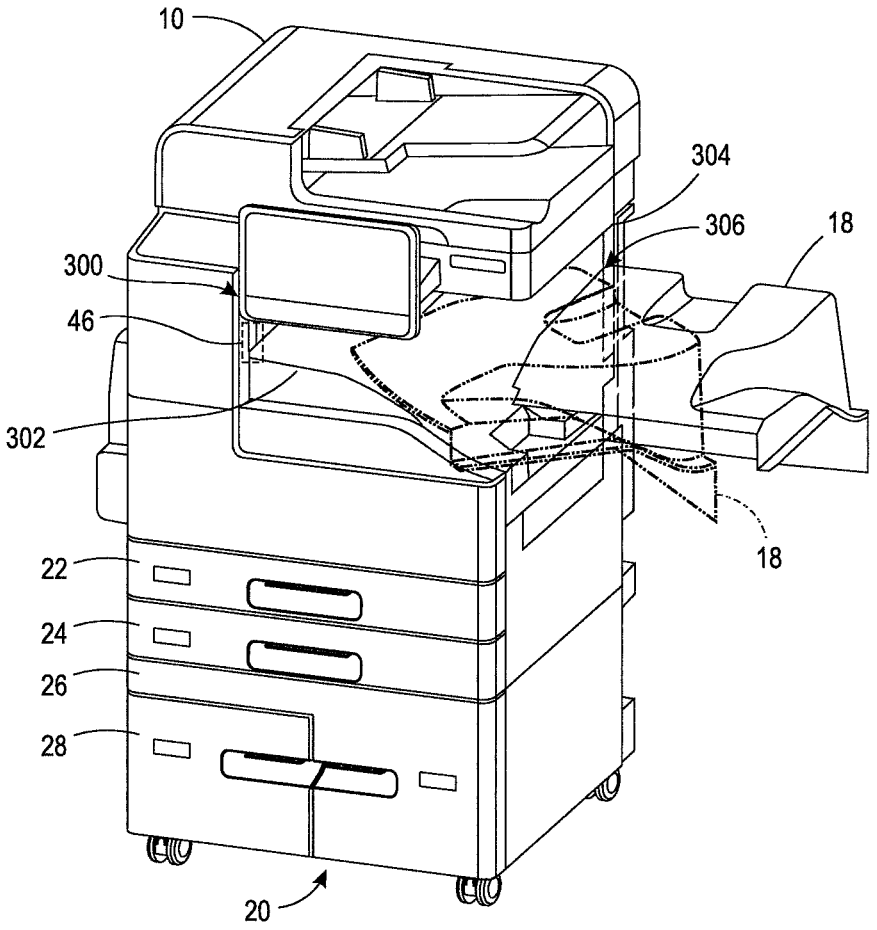
FIG. 7 is a three-dimensional view of an image rendering apparatus including a rotating center tray in accordance with one embodiment of the subject application.

With reference now to FIG. 7, there is shown another embodiment of the image rendering apparatus 10 of FIG. 1. Contrary to the embodiments illustrated in FIGS. 3A-6B, the image rendering apparatus 10 of FIG. 7 does not include the aforementioned retraction mechanism 48 to allow access to the center tray 18. Accordingly, the image rendering apparatus 10 of FIG. 7 is configured to extend/retract the center tray 18 via rotation of a pivot mechanism 306 to the side of the image rendering apparatus 10. That is, the pivot mechanism 306 rotates the center tray 18 from the home position to the document retrieval (extended) position, as illustrated in FIG. 7.

As shown, FIG. 7 depicts the image rendering apparatus 10 having the center tray 18 in varying positions to illustrate the rotating access thereof. It will be appreciated that while in the home position the image rendering apparatus 10 may perform operations, whereas when the center tray 18 has rotated to the retrieval position, operations of the image rendering apparatus 10 may be prohibited via the control unit 50 as referenced above. The pivot 306 depicted in FIG. 7, may be a post, hinge, pillar, or other suitable mechanism around which or upon which the center tray 18 may rotate from the home position to the retrieval position and back. Accordingly, the pivot mechanism 306 is intended to illustrate one possible mechanism to allow the center tray 18 to rotate out for document retrieval and rotate back to the home position for further operations. The pivot mechanism 306, as briefly described above, may include, for example and without limitation, a hinge pin, gear-driven post, spring driven post, or other rotational mechanism, as will be appreciated by those skilled in the art. In the embodiment illustrated in FIG. 7, the pivot mechanism 306 is located at the corner of the rear wall 304 of the cavity 302, and may be implemented as manually, mechanically or electrically (automatically) activated.

Furthermore, as with the embodiment discussed above with respect to FIGS. 3B, 4B, 5B, and 6B, the center tray 18 need not extend fully as illustrated in FIG. 7 and that the illustration in FIG. 7 of the center tray 18 fully rotated about the pivot mechanism 306 is merely intended as an example demonstrating the direction of travel of the center tray 18. That is, the skilled artisan will appreciate that while illustrated as fully rotating, the center tray 18 may only need rotate a portion, e.g. enough to allow retrieval of the output by a user, i.e., greater than 0%, but less than 100%. For example, the center tray 18 may rotate 20% to 90% outward, and more preferably between 25% and 50%, so as to allow for ease of access to the output, while ensuring quick rotation back to the home position for additional operations by the image rendering apparatus 10.

Accordingly, the amount of rotation applied to the center tray 18 may be limited based upon weight of the center tray 18, size/strength of retraction mechanism (if so equipped), location of the image rendering apparatus 10 relative to walls, etc., and the like. In the embodiment illustrated in FIG. 7, the at least one position sensor 46 is configured to detect the position of the center tray 18 during operations of the image rendering apparatus 10. Suitable examples of such a sensor 46 include, without limitation a simple mechanical switch, magnetically activated reed switch or Hall Effect sensor, optical interrupt sensor, or other positional mechanism, as will be appreciated by those skilled in the art. It will be appreciated that while shown in FIG. 7 as positioned adjacent the interior wall 300 of the cavity 302 in which the center tray 18 is located, the sensor 46 may also be positioned adjacent the back wall 304 of the cavity 302. Furthermore, the sensor 46, may be positioned at different locations within the cavity 302 of the image rendering apparatus 10, alternatively positioned on the center tray 18 itself, affixed to the pivot mechanism 306, or affixed to the motor 102 (dependent upon the location of the motor 102). Alternative placement of the sensor 46 will be understood by those skilled in the art, such that the sensor 46 is suitably located to detect the position of the center tray 18.

The use of a sensor 46, as illustrated in FIG. 7 is intended as an example of one embodiment, and as with the embodiments disclosed above with respect to FIGS. 3A-6B, the control unit 50 may determine the position of the center tray 18 via the position determination component 98 monitoring the rotation of the center tray 18 during operations of the image rendering apparatus 10. That is, the position determination component 98 utilizes the memory 54 to store information about whether the motor (not shown) has rotated the center tray 18, as will be appreciated by those skilled in the art.

Figure 8:
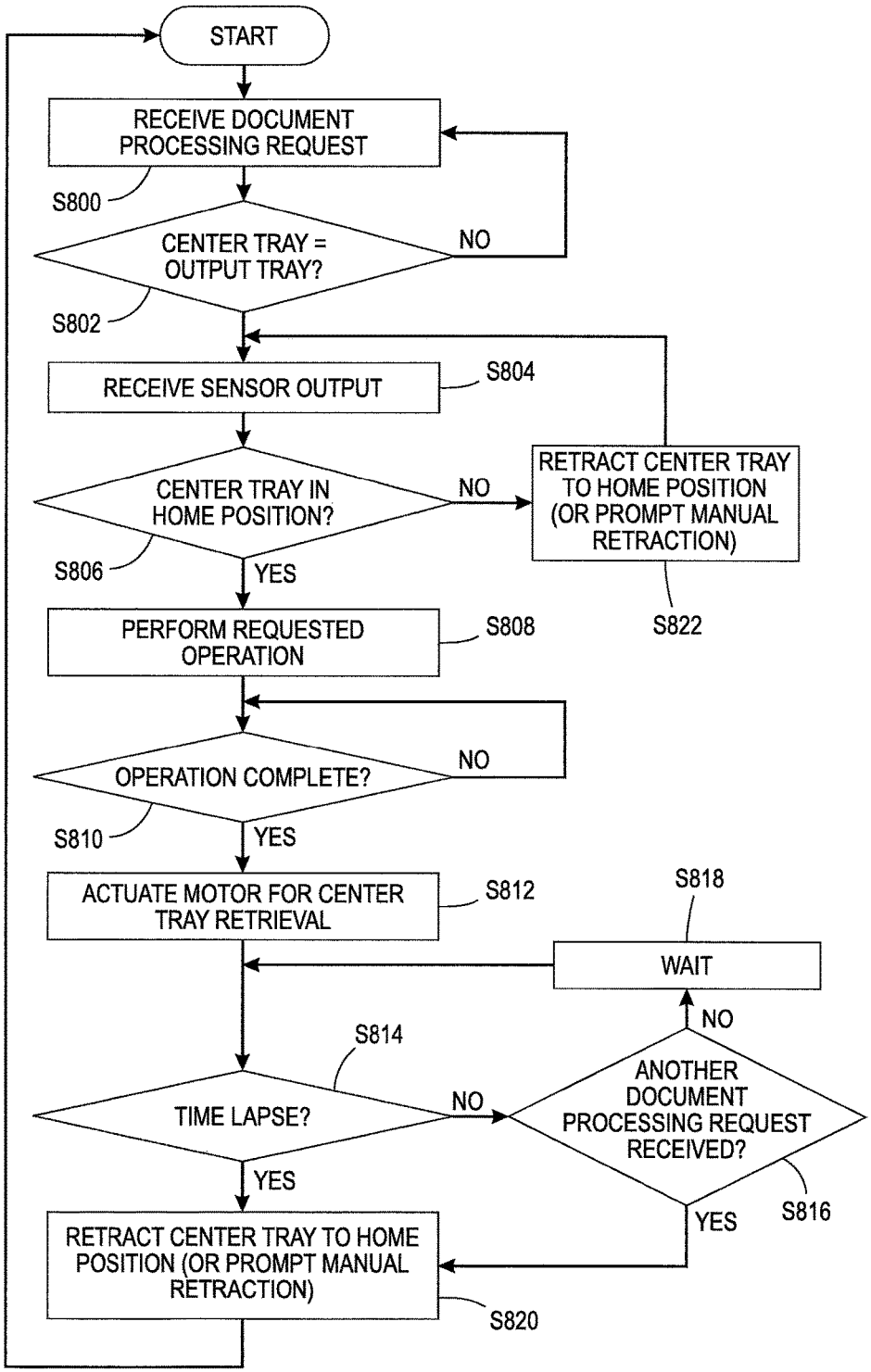
FIG. 8 illustrates a method for operating a center tray of an image rendering apparatus according to one embodiment of the subject application.

Turning now to FIG. 8, there is shown an exemplary method for operating a center tray 18 of an image rendering apparatus 10, 14 in accordance with one embodiment of the subject application. The method begins at step S800, whereupon a document processing request is received by the control unit 50 of the image rendering apparatus 10, 14 via any suitable means. Suitable means include, for example and without limitation, a facsimile operation, a copying operation, a printing operation, a scanning operation, or the like. A determination is then made at step S802 whether the center tray 18 is the output tray for the received document processing operation. Upon a negative determination at step S802, operations return to step S800 for receipt of the next document processing request. Upon a positive determination at step S802, operations progress to step S804, whereupon the control unit 50 receives an output from the at least one sensor 46 as to the position of the center tray 18. The control unit 50 then determines, at step S806, if the center tray 18 is in the home position in response to the received output from the at least one sensor 46.

Upon a positive determination at step S806, operations proceed to step S808, whereupon the image rendering apparatus 10, 14 performs the requested document processing operation. A determination is then made at step S810 whether the document processing operation has completed. Upon a negative determination, operations return to step S810 for until such time as the document processing operation performed by the image rendering apparatus 10, 14 has completed. That is, the center tray 18 remains in the home position awaiting output of the print job thereon. Upon a positive determination at step S810, operations proceed to step S812, whereupon the control unit 50 actuates the motor 102 to extend (or rotate) the center tray 18 to the retrieval position.

A determination is then made at step S814 whether the center tray 18 has remained in the retrieval position for a predetermined period of time. In an alternative embodiment, the center tray 18 includes a sensor (not shown) that detects the presence of an output document, such that when the sensor indicates no output document is present, i.e., has been removed, the control unit 50 or other suitable component of the image rendering apparatus 10, 14 prompts the retraction of the center tray 18 to the home position as discussed below regarding step S820. That is, whether the center tray 18 has been extended (or rotated outward) for a selected amount of time, e.g., greater than 30 seconds, greater than one minute, greater than two minutes, etc. It will be appreciated that the amount of time may be set by an associated user, the manufacturer (default), the system administrator, or the like, via interactions with the GUI and/or control unit 50. Upon a negative determination at step S814, a determination is made whether another document processing request has been received by the image rendering apparatus 10, 14 at step S816. Upon a negative determination, operations proceed to step S818, whereupon the center tray 18 remains in the retrieval position until a positive determination is made at step S814 or step S816 (whichever occurs first), whereupon operations proceed to step S820 for activation of the retraction mechanism 48 to retract the center tray 18 to the home position. In accordance with some embodiments, the control unit 50 at step S820 may prompt the user to manually retract (i.e. return) the center tray 18 to the home position via an audible and/or visual alert, e.g. alarm, visual queue on GUI of display 46, or the like. Thereafter, operations of the image rendering apparatus 10, 14 return to step S800 for additional document processing operations.

Returning to step S806, upon a determination by the control unit 50, via output of the position determination unit 98 that the center tray 18 is in the retrieval position, operations proceed to step S822. At step S822, the control unit 50 actuates the retraction mechanism 48 to return the center tray 18 to the home position. In some embodiments, the control unit 50, via the GUI or other suitable notification means (audible and/or visual), may prompt a user to manually retract the center tray 18 at step S822. It will be appreciated that actuation of the retraction mechanism 48 may include, for example and without limitation, mechanical release of spring/tension device, actuation of the motor 102, or the in case of manual retraction, visual alert via the display 44 and/or audible alert via an associated speaker. Operations then return to step S804, whereupon the control unit 50 receives sensor output and confirms the home positioning of the center tray 18 at step S806, thereafter operations progress to step S808 wherein the image rendering apparatus 10, 14 performs the requested document processing operation as described above.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An image rendering apparatus, comprising:

a cavity;

a center tray having a home position located within said cavity and a retrieval position located outside said cavity;

a retraction mechanism mechanically coupled to the center tray and at least one interior wall of said cavity, wherein the retraction mechanism is configured to allow for movement of the center tray from the home position to the retrieval position, and from the retrieval position to the home position;

a processor; and memory in communication with the processor, the memory storing instructions which are executed by the processor causing the processor to:

determine an amount of time the center tray is in the retrieval position, and responsive to a determination that the amount of time has exceeded a predetermined time, actuate the retraction mechanism to return the center tray to the home position.

2. The image rendering apparatus of claim 1, wherein the retraction mechanism comprises at least one of the group of a track, a rail, a telescoping rail, a pivot mechanism, or a rack and pinion.

3. The image rendering apparatus of claim 1, wherein the retraction mechanism is activated via at least one of the group comprising manual extraction and mechanical retraction, manual extraction and electrical retraction, or electrical extraction and electrical retraction.

4. The image rendering apparatus of claim 3, further comprising a motor operatively coupled to the retraction mechanism, the motor configured to move the center tray using the retraction mechanism from the retrieval position to the home position.

5. The image rendering apparatus of claim 4, wherein the motor is operative to move the center tray using the retraction mechanism from the home position to the retrieval position.

6. The image rendering apparatus of claim 4, further comprising at least one sensor located within the cavity, the at least one sensor operative to sense the position of the center tray relative to the cavity.

7. The image rendering apparatus of claim 6, wherein the memory further stores instructions which are executed by the processor causing the processor to:

determine a position of the center tray in accordance with an output of the at least one sensor, and disable operations of the image rendering apparatus in response to an output of the at least one sensor indicating the center tray is in the retrieval position.

8. The image rendering apparatus of claim 7, wherein the memory further stores instructions which when executed by the processor causes the processor to actuate the motor to move, via the retraction mechanism, the center tray from the retrieval position to the home position.

9. The image rendering apparatus of claim 8, wherein the memory further stores instructions which when executed by the processor causes the processor to actuate the motor to move, via the retraction mechanism, the center tray from the home position to the retrieval position.

10. The image rendering apparatus of claim 9, wherein the retraction mechanism is a pivot mechanism configured to rotate the center tray outward from the cavity to the retrieval position.

11. The image rendering apparatus of claim 10, wherein the pivot mechanism is operatively coupled to the motor, the motor operative to actuate the pivot mechanism to effectuate rotation of the center tray.

12. The image rendering apparatus of claim 11, wherein the center tray is configured to rotate outward from about 20% to 90% from the cavity.

13. The image rendering apparatus of claim 9, wherein the center tray is configured to move from 20% to 90% outward from the cavity.

14. A method for center tray retrieval of on an image rendering apparatus, the method comprising the steps of:

receiving a document processing request representative of an operation of the image rendering apparatus;

receiving sensor output from a sensor located within a cavity of the image rendering apparatus, the sensor output corresponding to a position of the center tray located therein;

responsive to the center tray in a home position, performing the received document processing request; and actuating a retraction mechanism operatively coupled to the center tray to move the center tray from a home position in the cavity to a retrieval position outside the cavity;

determining an amount of time the center tray is in the retrieval position; and responsive to a determination that the amount of time has exceeded a predetermined time, actuating the retraction mechanism to return the center tray to the home position.

15. The method of claim 14, further comprising the steps of:

determining, from an output of the sensor, that the center tray is in the retrieval position; and disabling operations of the image rendering apparatus.

16. The method of claim 14, wherein actuating the retraction mechanism further comprises:

actuating a motor operatively coupled to the retraction mechanism, the motor utilizing the retraction mechanism to move the center tray from the home position to the retrieval position.

17. The method of claim 16, further comprising the steps of:

receiving, from the sensor, an output indicating the center tray is in the retrieval position prior to performing the received document processing request;

actuating the motor to retract the center tray from the retrieval position to the home position within the cavity; and performing the received document processing request subsequent to the center tray retracting to the home position.

18. A method for center tray retrieval of on an image rendering apparatus, the method comprising the steps of:

receiving a document processing request representative of an operation of the image rendering apparatus;

receiving sensor output from a sensor located within a cavity of the image rendering apparatus, the sensor output corresponding to a position of the center tray located therein;

responsive to the center tray in a home position, performing the received document processing request;

actuating a retraction mechanism operatively coupled to the center tray to move the center tray from a home position in the cavity to a retrieval position outside the cavity;

determining whether a new document processing request has been received by the image rendering apparatus; and responsive to a determination that a new document processing request has been received, actuating the retraction mechanism to return the center tray to the home position.

19. An image rendering apparatus, comprising:

a cavity;

a center tray having a home position located within said cavity and a retrieval position located outside said cavity;

a retraction mechanism mechanically coupled to the center tray and at least one interior wall of said cavity, wherein the retraction mechanism is configured to allow for movement of the center tray from the home position to the retrieval position, and from the retrieval position to the home position;

a sensor located within said cavity;

a processor; and memory in communication with the processor, the memory storing instructions which when executed by the processor cause the processor to:

determine a position of the center tray in the cavity in accordance with an output of the sensor, enable operations of the image rendering apparatus in response to a determination that the center tray is in the home position, receive a document processing request representative of an operation of the image rendering apparatus, responsive to a determination that the center tray is in the home position, perform the received document processing request, and actuate the retraction mechanism operatively coupled to the center tray to move the center tray from the home position in the cavity to the retrieval position outside the cavity, determine an amount of time the center tray is in the retrieval position, and responsive to a determination that the amount of time has exceeded a predetermined time, actuate the retraction mechanism to return the center tray to the home position.

20. The image rendering apparatus of claim 19, further comprising a sensor located within a cavity of the image rendering apparatus, wherein the memory further stores instructions which are executed by the processor to determine the position of the center tray in accordance with an output of the sensor.

21. The image rendering apparatus of claim 20, wherein the retraction mechanism comprises at least one of the group of a track, a rail, a telescoping rail, a pivot mechanism, or a rack and pinion.

22. The image rendering apparatus of claim 21, further comprising a motor operatively coupled to the retraction mechanism, the motor configured to move the center tray using the retraction mechanism from the retrieval position to the home position and from the home position to the retrieval position.

23. An image rendering apparatus, comprising:

a cavity;

a center tray having a home position located within said cavity and a retrieval position located outside said cavity;

a retraction mechanism mechanically coupled to the center tray and at least one interior wall of said cavity, wherein the retraction mechanism is configured to allow for movement of the center tray from the home position to the retrieval position, and from the retrieval position to the home position;

a sensor located within said cavity;

a processor; and memory in communication with the processor, the memory storing instructions which when executed by the processor cause the processor to:

determine a position of the center tray in the cavity in accordance with an output of the sensor, enable operations of the image rendering apparatus in response to a determination that the center tray is in the home position, receive a document processing request representative of an operation of the image rendering apparatus, determine whether a new document processing request has been received by the image rendering apparatus, and responsive to a determination that a new document processing request has been received, actuate the retraction mechanism to return the center tray to the home position.

24. An image rendering apparatus, comprising:

a cavity;

a center tray having a home position located within said cavity and a retrieval position located outside said cavity;

a retraction mechanism mechanically coupled to the center tray and at least one interior wall of said cavity, wherein the retraction mechanism is configured to allow for movement of the center tray from the home position to the retrieval position, and from the retrieval position to the home position;

a processor; and memory in communication with the processor, the memory storing instructions which are executed by the processor causing the processor to:

determine whether a new document processing request has been received by the image rendering apparatus; and responsive to a determination that a new document processing request has been received, actuate the retraction mechanism to return the center tray to the home position.

25. The image rendering apparatus of claim 24, wherein the retraction mechanism is activated via at least one of the group comprising manual extraction and mechanical retraction, manual extraction and electrical retraction, or electrical extraction and electrical retraction.

26. The image rendering apparatus of claim 24, further comprising:

at least one sensor located within the cavity, the at least one sensor operative to sense the position of the center tray relative to the cavity, wherein the memory further stores instructions which are executed by the processor causing the processor to:

determine a position of the center tray in accordance with an output of the at least one sensor, and disable operations of the image rendering apparatus in response to an output of the at least one sensor indicating the center tray is in the retrieval position.

* * * * *